US008978908B2

(12) United States Patent
Lilienthal et al.

(10) Patent No.: US 8,978,908 B2
(45) Date of Patent: Mar. 17, 2015

(54) DISPENSING HEAD WITH OVERMOLDED HINGE CAP

(75) Inventors: Hans-Peter Lilienthal, Hamburg (DE); Herve Bodet, Verdun (FR)

(73) Assignee: Lindal France SAS, Briey (FR)

( * ) Notice: Subject to any disclaimer, the term of this patent is extended or adjusted under 35 U.S.C. 154(b) by 1231 days.

(21) Appl. No.: 12/513,760

(22) PCT Filed: Nov. 8, 2007

(86) PCT No.: PCT/EP2007/062090

§ 371 (c)(1),
(2), (4) Date: May 6, 2009

(87) PCT Pub. No.: WO2008/055961

PCT Pub. Date: May 15, 2008

(65) Prior Publication Data

US 2009/0321379 A1 Dec. 31, 2009

(30) Foreign Application Priority Data

Nov. 9, 2006 (FR) ..... 06 09780

(51) Int. Cl.
*B65D 47/08* (2006.01)
*B65D 35/12* (2006.01)

(52) U.S. Cl.
CPC ..... *B65D 35/12* (2013.01); *B65D 47/0809* (2013.01); *B65D 47/0838* (2013.01)
USPC ..... 215/237; 215/235; 215/316

(58) Field of Classification Search
USPC ..... 215/216, 235, 237, 316; 220/254.3, 220/837, 838; 222/546, 556
See application file for complete search history.

(56) References Cited

U.S. PATENT DOCUMENTS

| | | | | | |
|---|---|---|---|---|---|
| 2,111,186 | A | * | 3/1938 | Jenks | 222/498 |
| 3,059,816 | A | * | 10/1962 | Goldstein | 222/109 |
| 3,752,371 | A | * | 8/1973 | Susuki et al. | 222/182 |
| 4,010,875 | A | * | 3/1977 | Babiol | 222/517 |
| 4,082,201 | A | * | 4/1978 | Bittel | 220/834 |
| 4,209,100 | A | * | 6/1980 | Uhlig | 215/216 |
| 4,291,818 | A | * | 9/1981 | Nozawa et al. | 220/832 |
| 4,782,964 | A | * | 11/1988 | Poore et al. | 215/216 |
| 4,795,043 | A | * | 1/1989 | Odet et al. | 215/235 |
| 4,809,874 | A | * | 3/1989 | Pehr | 220/833 |

(Continued)

FOREIGN PATENT DOCUMENTS

| | | | |
|---|---|---|---|
| FR | 2731983 | A1 * | 9/1996 |
| FR | 2752818 | A1 | 3/1998 |

(Continued)

OTHER PUBLICATIONS

International Search Report of PCT/EP2007/062090, date of mailing Apr. 17, 2008.

*Primary Examiner* — Anthony Stashick
*Assistant Examiner* — Ned A Walker
(74) *Attorney, Agent, or Firm* — Westerman, Hattori, Daniels & Adrian, LLP

(57) ABSTRACT

A dispensing head (103) for closing a vessel, mainly a tube or a vial, includes an outlet opening (135) and a hinged cap (104) for closing the opening (135) of the dispensing head. The dispensing head (103) and the hinged cap (104) are made of a single piece. The hinged cap (104) is molded over the dispensing head (103). The cap (104) can be secured onto the head (103) by anchoring even when the materials are not compatible.

17 Claims, 6 Drawing Sheets

(56) References Cited

U.S. PATENT DOCUMENTS

| | | | | |
|---|---|---|---|---|
| 4,863,048 | A * | 9/1989 | Iizuka et al. | 215/235 |
| 4,892,208 | A * | 1/1990 | Sledge | 215/216 |
| 5,221,017 | A * | 6/1993 | Cistone et al. | 215/235 |
| 5,301,849 | A | 4/1994 | Guglielmini et al. | |
| 5,497,906 | A * | 3/1996 | Dubach | 222/23 |
| 5,573,127 | A * | 11/1996 | Takahashi et al. | 215/237 |
| 5,735,419 | A * | 4/1998 | Ma | 215/253 |
| 5,868,265 | A * | 2/1999 | Kobayashi | 215/235 |
| 5,950,848 | A | 9/1999 | Baudin | |
| 6,039,197 | A * | 3/2000 | Braun | 215/228 |
| 6,305,563 | B1 | 10/2001 | Elliott | |
| 6,405,896 | B2 * | 6/2002 | Jud et al. | 222/107 |
| 6,409,034 | B2 * | 6/2002 | Schorner | 215/237 |
| 6,834,769 | B2 * | 12/2004 | Takahashi et al. | 215/235 |
| 6,971,531 | B1 * | 12/2005 | Dubach | 215/235 |
| 6,981,607 | B2 * | 1/2006 | Lown et al. | 220/254.3 |
| 6,991,138 | B2 * | 1/2006 | Marroncles | 222/402.11 |
| D515,921 | S * | 2/2006 | Marroncles | D9/449 |
| 7,051,888 | B2 * | 5/2006 | Antier et al. | 215/235 |
| 7,611,024 | B2 * | 11/2009 | Yamanaka et al. | 215/237 |
| 7,717,281 | B2 * | 5/2010 | Baudin | 215/235 |
| 7,992,737 | B2 * | 8/2011 | Salice | 220/4.23 |
| 8,006,853 | B2 * | 8/2011 | Delage | 215/237 |
| 2001/0050291 | A1 * | 12/2001 | Jud et al. | 222/107 |
| 2002/0148802 | A1 * | 10/2002 | Takahashi et al. | 215/237 |
| 2003/0178744 | A1 | 9/2003 | Schneider | |
| 2004/0178166 | A1 * | 9/2004 | Antier et al. | 215/235 |
| 2005/0173366 | A1 * | 8/2005 | Baudin | 215/235 |
| 2005/0230504 | A1 * | 10/2005 | Marroncles | 239/589 |
| 2006/0108364 | A1 * | 5/2006 | Benktzon et al. | 220/324 |
| 2006/0273062 | A1 * | 12/2006 | Delage | 215/237 |
| 2007/0095864 | A1 * | 5/2007 | Vangeel et al. | 222/556 |
| 2007/0205177 | A1 * | 9/2007 | Delage | 215/305 |
| 2008/0011704 | A1 * | 1/2008 | Van Ryn | 215/235 |
| 2008/0283539 | A1 * | 11/2008 | Salice | 220/838 |

FOREIGN PATENT DOCUMENTS

| | | | |
|---|---|---|---|
| JP | 59057727 | A * | 4/1984 |
| JP | 59109332 | A * | 6/1984 |
| JP | 60-247520 | A | 12/1985 |
| WO | 01/78958 | A1 | 10/2001 |

* cited by examiner

DISPENSING HEAD WITH OVERMOLDED HINGE CAP

BACKGROUND ART

The invention concerns a dispensing head for closing a receptacle, in particular a tube or bottle, provided with an outlet orifice and a hinge cap for closing the orifice of the dispensing head, the dispensing head and the hinge cap forming a single piece.

Such dispensing heads are normally used in the field of cosmetics and parapharmacy. It is thus possible to open the tube with a hand holding the tube or bottle while making the cap pivot, without its being necessary to unscrew a part, which can easily be lost.

Such dispensing heads in one piece are known from the documents EP 1 162 154 A1, U.S. Pat. No. 5,036,889 and FR 2 731 983 A1. The dispensing head and hinge cap are injected together in the same mould. The assembly is therefore produced in the same material and with the same colour. However, it may sometimes be useful to produce the hinge cap in a colour or material different from the dispensing head.

SUMMARY OF THE INVENTION

The objective of the invention is to make it possible to manufacture a dispensing head provided with a hinge cap, these two elements forming only a single piece, which makes it possible to use materials with different colours and/or compositions for the dispensing head and hinge cap.

This objective is achieved according to the invention through the fact that the hinge cap is moulded onto the dispensing head. Thus the dispensing head is manufactured in a first step and then the hinge cap is moulded onto this dispensing head. It is thus possible to use materials with different colours for each of the two elements.

In order to be able to use incompatible materials for the two elements, that is to say materials that do not fuse together and therefore do not adhere to each other, it is preferable to provide anchoring means for fixing the hinge cap to the dispensing head. It is thus possible to produce the dispensing head in a first material while providing first anchoring means and then moulding the hinge cap on in a material incompatible with that of the dispensing head, this second material engaging in the first anchoring means in order to form together the anchoring means.

It is preferable for the dispensing head to carry first anchoring means, preferably a groove, and the hinge cap second anchoring means, preferably a tongue entering the groove, or vice versa. To provide even stronger anchoring, it is possible to design the anchoring means in the form of hooks.

The dispensing head can be welded to the receptacle that it is to close, for example a flexible tube, or to be fixed on top by means of fixing means such as a thread or snapping-on means, for example to close a bottle.

As mentioned previously, the hinge cap and dispensing head can be produced from the same material in the same colour or in different colours, or from materials having the same colour or different colours, these materials being able to be compatible or incompatible with each other.

In order to prevent the odours from the content of the tube being perceptible when the latter is closed, it is advantageous to include a barrier in the dispensing head and/or hinge cap, for example in the form of an insert impervious to odours and/or gases.

It is preferable to provide the dispensing head with a removable lid and/or one that can be perforated to close its orifice.

In order to prevent any leakage of the content, it is advantageous to provide sealing means on the dispensing head and/or on the hinge cap in order to seal the receptacle when the hinge cap is closed.

To allow easy opening of the hinge cap, it is preferable to provide means for facilitating the opening of the cap with a finger, in particular in the form of a bonnet.

To prevent the hinge cap interfering with sampling and to facilitate its opening, it is advisable to provide means for moving the hinge cap into a wide-open position and/or into the closed position or into a position close to these, when the hinge cap is not subjected to any external force.

In order to facilitate the dispensing of the product, in particular when the receptacle is almost empty, the dispensing head has radial shoulders inclined with respect to a radial plane by an angle of between 5° and 45°, preferable by an angle of 15°. In particular, its top wall is slightly inclined in order to prevent the appearance of right angles or acute angles that might retain the product.

It is preferable to produce the dispensing head and/or the hinge cap from EVA (ethylene vinyl alcohol), ORGALLOY® thermoplastic alloy (a mixture of polyamide and polypropylene), PP (polypropylene), HDPE (high-density polyethylene) or LDPE (low-density polyethylene).

BRIEF DESCRIPTION OF THE DRAWINGS

The invention is described in more detail below with the help of the figures, which show:

FIG. 1*a* is a side view of a first embodiment of a dispensing head according to the invention, the cap being in the closed position, and FIG. 1*b* shows a view in section of the embodiment in FIG. 1*a* along line 1*b*-1*b* of FIG. 1*a;*

FIG. 6*a* is a view of a detail of FIG. 2 comprising a top portion of a head body and showing the angle (α), and FIG. 6*b* is a view of the detail of FIG. 2 with a removable opercule applied to a top opening;

FIG. 7*a* is a top view of a second embodiment of the dispensing head according to the invention, the cap being in open position, FIG. 7*b* is a perspective view in section of the embodiment in FIG. 7*a* along line 7*b*, 7*b*-7*b*, 7*c* of FIG. 7*a*, FIG. 7*c* is an elevation view in section of the embodiment in FIG. 7*a* along line 7*b*, 7*b*-7*b*, 7*c* of FIG. 7*a*, the head being mounted on a container, FIG. 7*d* is an elevation view in section of the detail referenced "See FIG. 7*d*" of a head body portion in FIG. 7*c*, and FIG. 7*e* is a schematic elevation view in section of a head body portion in a variant with barrier layer insert;

FIG. 8*a* is a perspective section view of an enlargement at the hinge referenced "See FIG. 8*a*" in FIG. 7*b*, FIG. 8*b* is a section view of the enlargement shown in FIG. 8*a*, FIG. 8*c* is a section view corresponding to FIG. 8*b*, in a variant with hook, FIG. 8*d* is a section view corresponding to FIG. 8*b*, in a variant with reversed anchoring means, FIG. 8*e* is a section view corresponding to FIG. 8*d*, in a variant with hook.

DETAILED DESCRIPTION OF PARTICULAR EMBODIMENTS

The dispensing head (3, 103) of the invention is provided with a cap (4, 104) fixed to the dispensing head by a hinge (41, 141).

Figure 1A:
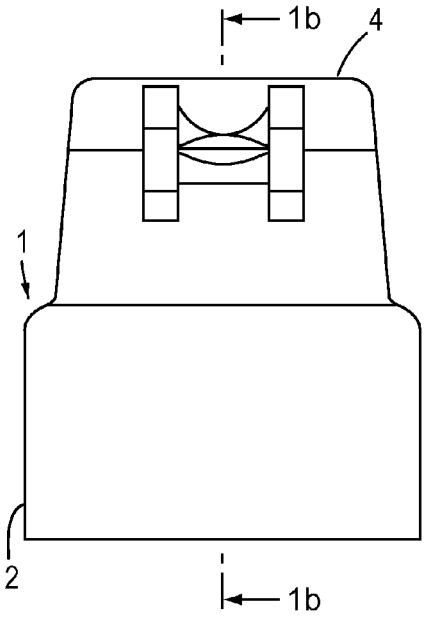
FIGS. 1*a* and 1*b*.
Figure 1B:
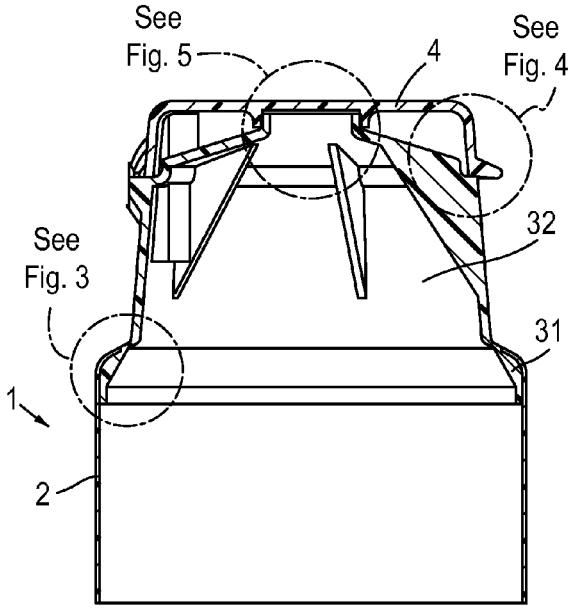
Figure 2:
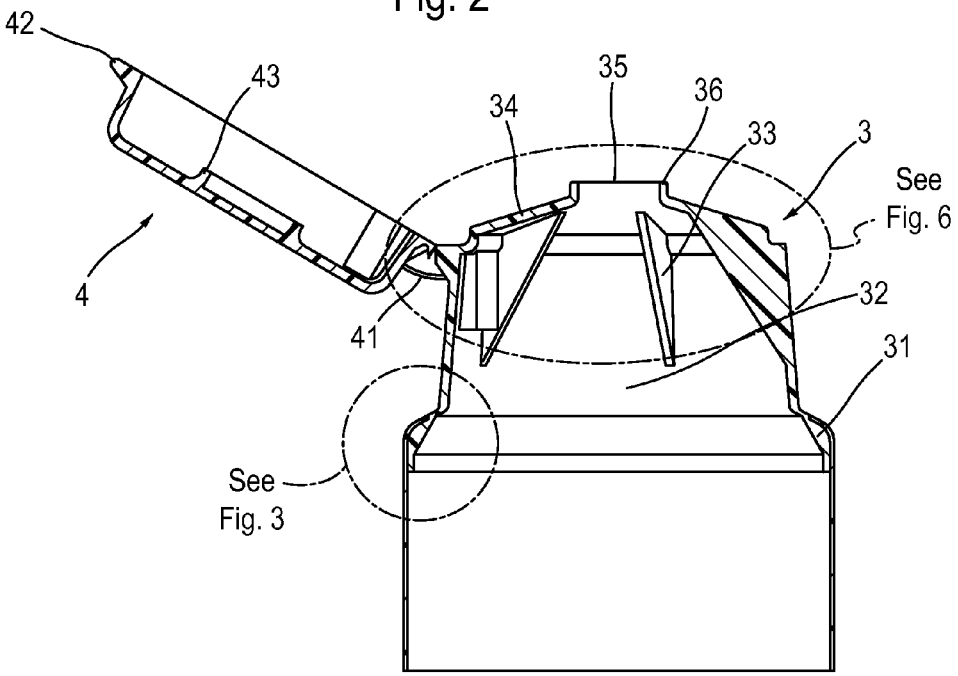
FIG. 2: a view in section of the tube in FIG. 1*b*, the cap being in the open position.

In the first example embodiment, the hinge is produced in the form of two film hinges (41) while in the second example embodiment it is a butterfly hinge (141). In both cases, the hinges are sized so that, without external forces, the cap (4, 104) tends to move either into a position close to the closed position in FIG. 1 or into the wide-open position in FIG. 2 as soon as it has passed a certain angle of opening. It is thus certain that the cap (4, 104) will not interfere with dispensing by going into an intermediate position, for example under the effect of its own weight. The cap (4, 104) is provided with a bonnet (42, 142) intended to facilitate its opening. It would also be possible to provide an indentation in the wall of the dispensing chamber (32, 132) to give a grip on the cap (4, 104).

According to the invention, the cap (4, 104) is moulded onto the head (3, 103). It is possible to use for the head and cap either materials that are identical or at least compatible, or incompatible materials. Overmoulding has the advantage of allowing the use of different materials and/or different colours for the dispensing head and for the cap. In all cases, the dispensing head (3, 103) and the cap (4, 104) form together a single piece.

When the materials used for the dispensing head (3) and the cap (4) are identical or compatible, overmoulding suffices to ensure cohesion and adherence of the two elements. The second material is moulded onto the first at the interface. This is the case adopted for the first embodiment. It is possible to choose the same material but different colours for the two elements or two different materials with identical or different colours. PP and EVA are for example compatible materials.

If on the other hand materials are used that are not compatible, that is to say that do not mould together and do not enable the cap to adhere to the head, it is necessary to provide means of anchoring the cap (104) and the head (103). This is the case with the second example embodiment. These anchoring means provided the mechanical fixing of the cap on the head. In the example embodiment presented, these anchoring means are formed by first anchoring means (138) situated on the head (103) and having the form of a groove produced in the head when it is manufactured. This groove (138) in the form of an arc of a circle preferably extends over the entire length of the hinge (141). At the time of overmoulding, the material of the cap enters this groove (138) forming a tongue (144) constituting the second anchoring means. After the assembly cools, an effect of shrinkage of the materials occurs, the consequence of which is an effect of gripping of the tongue (144) in the groove (138). The cap is therefore held in a vice in the groove (138) by its tongue (144) and can no longer emerge therefrom.

Figure 8A:
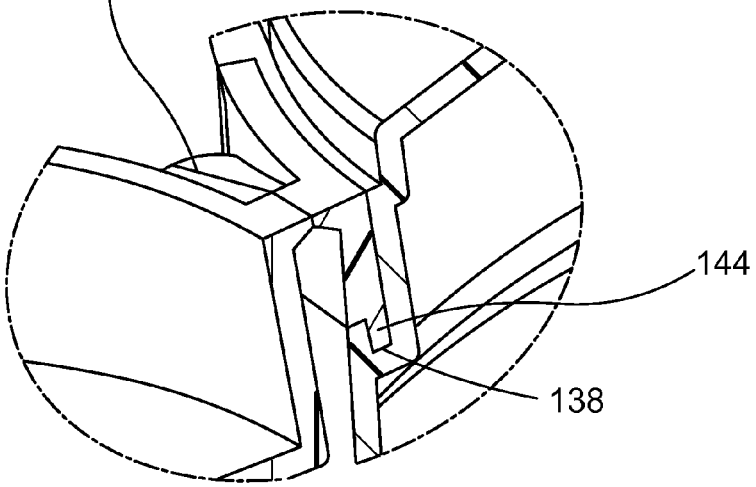
FIGS. 8*a*-8*e*.
Figure 8B:
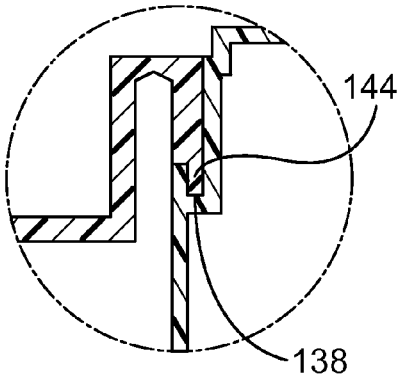
Figure 8C:
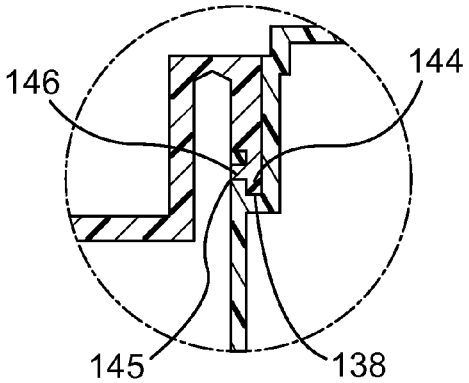
Figure 8D:
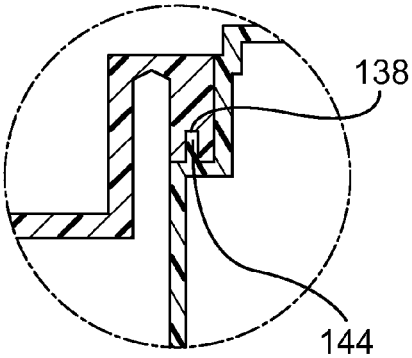
Figure 8E:
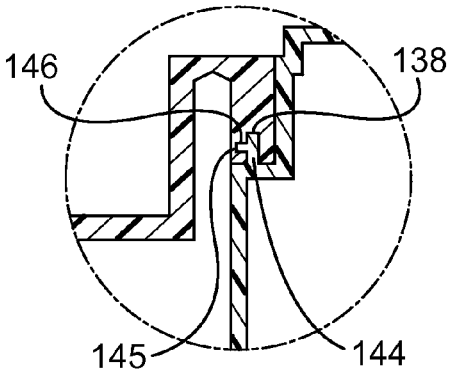

It is also possible to produce the anchoring means in the form of hooks. It is for example possible to supplement the pair consisting of groove (138) and tongue (144) in the example in FIGS. 8*a*-8*b* with radial holes (145) formed in the external wall of the groove (138), as shown on FIG. 8*c*. When the cap is moulded on, the second material will enter not only the groove (138) but also these holes. The cylinders (146) of the second material define hooks that enter the holes (145) produced in the first material.

In FIGS. 7*a*-7*e* and 8*a*-8*e*, the hinge is placed on the same side as the cap (104). It goes without saying that it is also possible to place it on the same side as the dispensing head (103). Likewise, the groove (138) can be placed on the cap and the tongue (144) on the head, as shown on FIGS. 8*d*-8*e*.

Among materials that are incompatible, or at least insufficiently compatible, PP and PE will be cited. However, it is advantageous to manufacture the head from PE to enable it for example to be welded to the skirt of a flexible tube, also made from PE, and to manufacture the cap from PP in order to obtain a more rigid object. Although it is possible at current working temperatures to obtain a certain adhesion of PP on PE, this is in general not sufficient to ensure sufficiently firm fixing of the PP cap on the PE head. The cap risks being rapidly pulled away if anchoring means are not provided.

In practice, a mould is used corresponding to the form of the dispensing head/hinge cap assembly. A core closes off the passage between the two elements corresponding to the hinge. If anchoring means are provided, this core provides the formation of the first anchoring means on the head. Once the head is produced and already partially cooled, the core is removed and the cap is moulded on.

Figure 3:
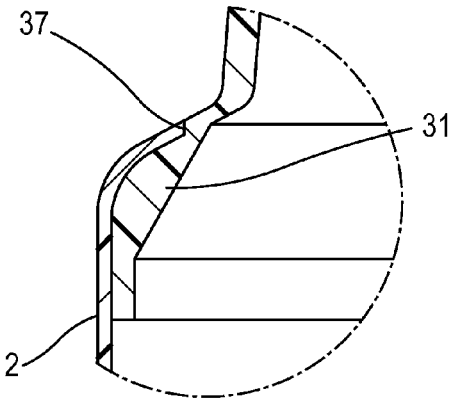
FIG. 3: an enlarged view of the detail referenced "See FIG. 3" in FIGS. 1*b* and 2.
Figure 4:
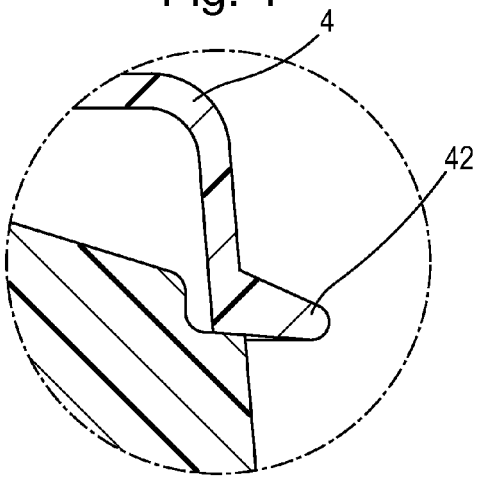
FIG. 4: an enlarged view of the detail referenced "See FIG. 4" in FIG. 1*b;*

The dispensing head (3, 103) can be fixed by welding to the skirt (2) of a flexible tube (1), as shown on FIG. 3. It will be possible to use for this purpose induction or ultrasonic welding means or any other suitable method known to persons skilled in the art. The welding is carried out between the top edge of the skirt (2) and the collar (31, 131) of the dispensing head (3, 103). To facilitate the welding, the collar (31, 131) has a shoulder (37) the height of which corresponds substantially to the thickness of the wall of the skirt (2).

It is also possible to make provision for fixing the dispensing head to the receptacle that it is to close by mechanical fixing means, such as a thread or snapping-on means.

The head (3, 103) comprises a collar (31, 131), a dispensing chamber (32, 132), cylindrical or slightly frustoconical, possibly reinforced by ribs (33), and terminates in its top part in a wall (34, 134) having an orifice (35, 135) through which the content of the receptacle can emerge. To improve the retrieval rate, it is preferable for this top wall (34, 134) to be slightly inclined with respect to the radial plane by an angle ($\alpha$) of between for example 5° and 45°, here 15°.

Figure 5:
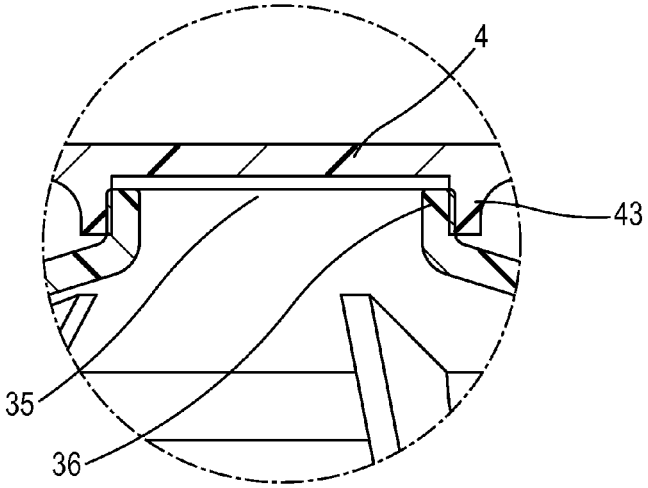
FIG. 5: an enlarged view of the detail referenced "See FIG. 5" in FIG. 1*b;*

In order to provide a seal between the orifice (35, 135) and the cap (4, 14), it is preferable to provide sealing means. In the example presented in FIG. 5, the sealing is provided by an external seal (43) placed in the bottom of the cap (4) and coming to surround the axial edge (36) of the orifice (35) from outside. This external seal is particularly well suited for viscous products such as toothpaste. For more liquid products, such as creams or lotions, it is preferable to use internal seals as in the example in FIGS. 7*a*-7*c*. In this case, the external seal is replaced by a cylindrical wall (143) that enters the orifice (135) practically without clearance.

To prevent the odour of the product contained in the tube from passing through it, a PBT or EVA barrier may be provided. The head and cap will then have at least one layer of this barrier material, such as barrier layer (147) shown on the head of FIG. 7*e*.

Figure 6A:
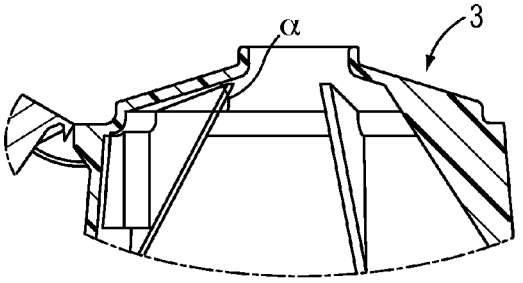
FIGS. 6*a* and 6*b*.
Figure 6B:
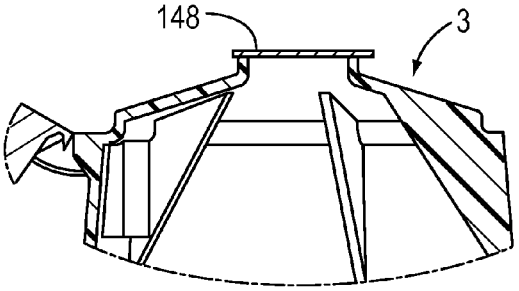
Figure 7A:
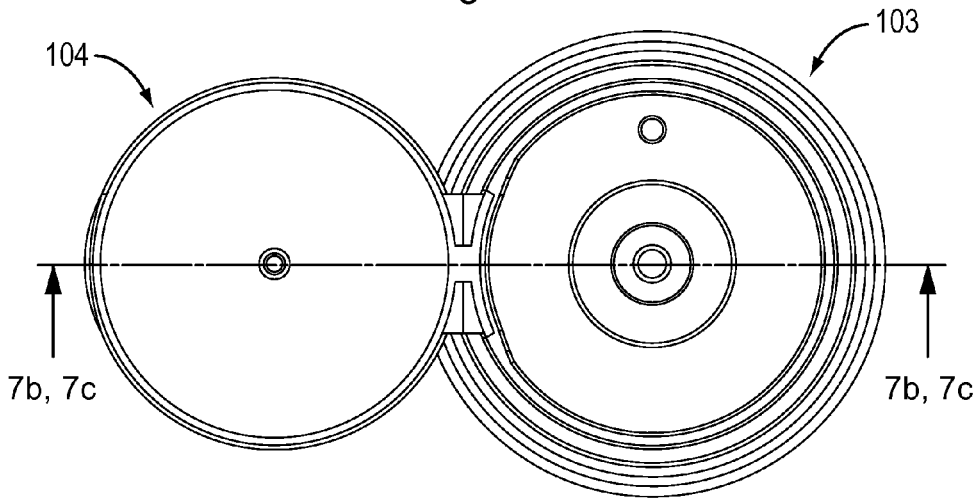
FIGS. 7*a*-7*e*.
Figure 7B:
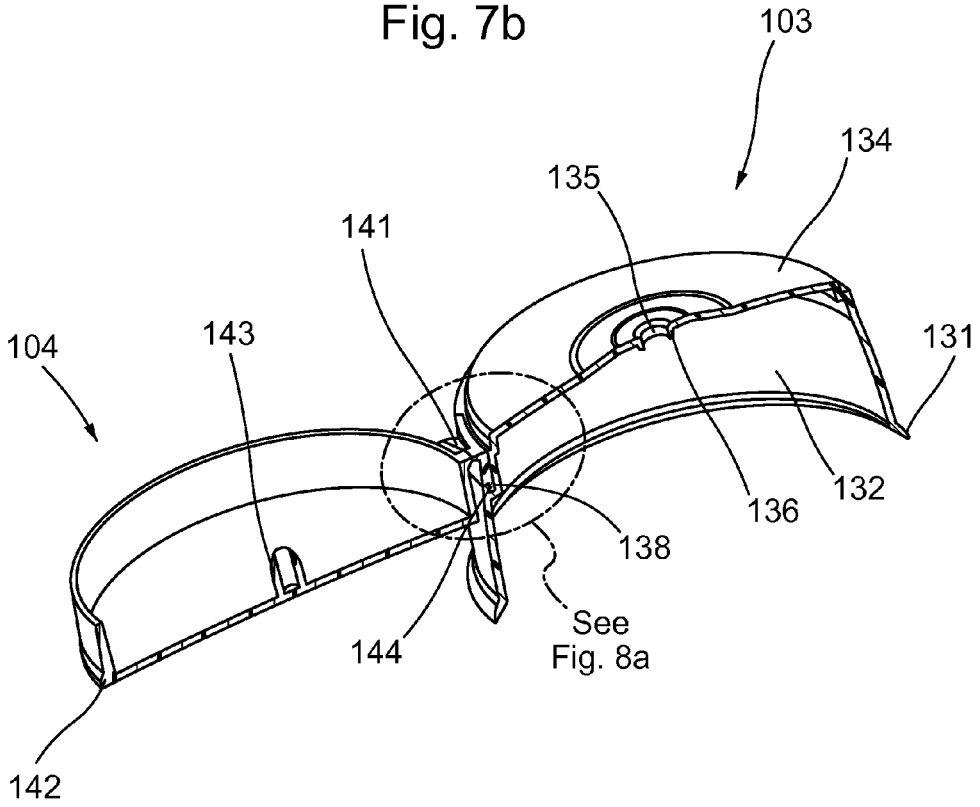
Figure 7C:
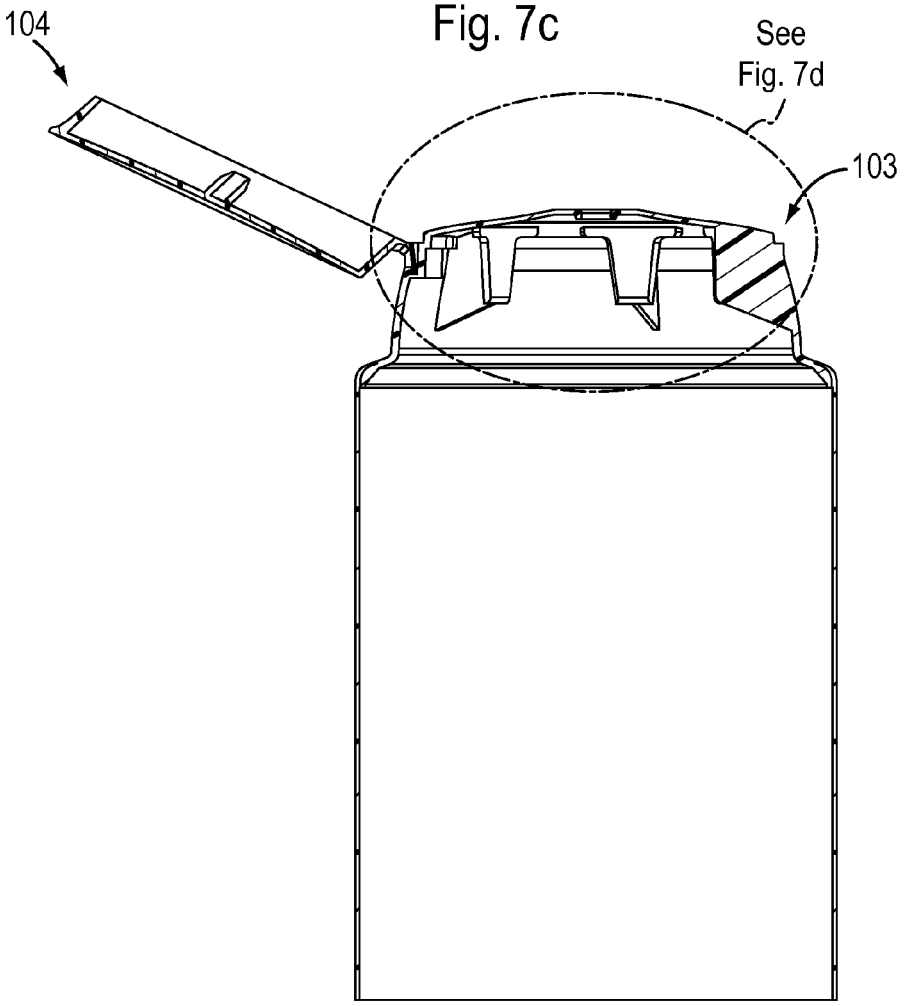
Figure 7D:
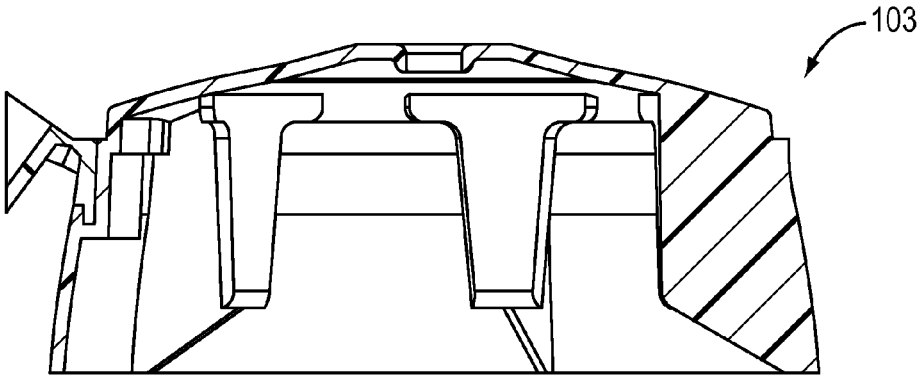
Figure 7E:
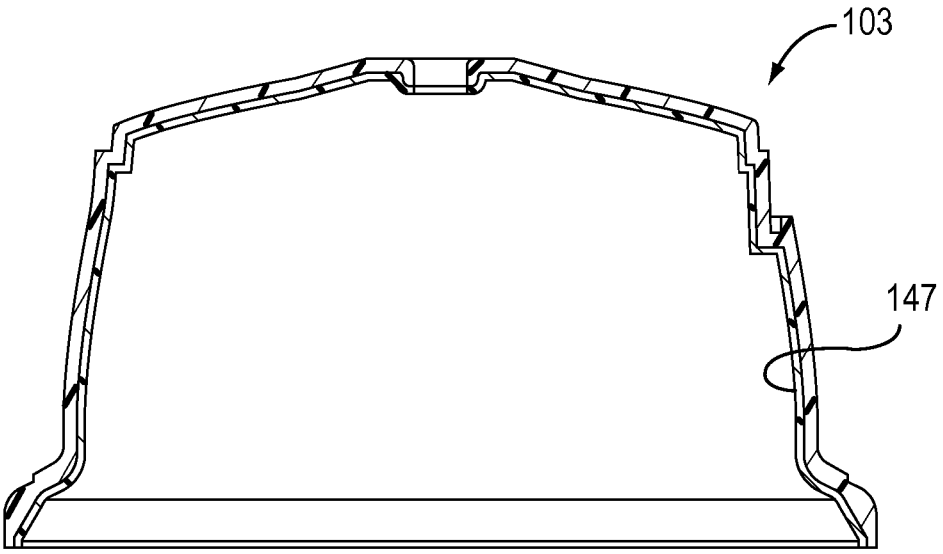

It will also be possible to provide a lid that can be removed or pierced at the time of first use, such as lid (148) shown on FIG. 6*b*. Likewise, it will be possible to provide tamper-evident means that will guarantee that the tube has not been opened before first use.

LIST OF REFERENCES

| | | |
|---|---|---|
| 1 | | Tube |
| 2 | | Skirt |
| 3 | 103 | Dispensing head |
| 31 | 131 | Collar |
| 32 | 132 | Dispensing chamber |
| 33 | | Ribs |
| 34 | 134 | Top wall |
| 35 | 135 | Orifice |
| 36 | 136 | Axial edge of the orifice |
| 37 | | Shoulder in the collar |
| | 138 | First anchoring means (groove) |
| 4 | 104 | Hinge cap |
| 41 | 141 | Film/butterfly hinge |
| 42 | 142 | Helmet |
| 43 | 143 | External/internal seal |
| | 144 | Second anchoring means (tongue) |
| | 145 | Radial holes |
| | 146 | Cylinders forming hooks |
| | 147 | Barrier layer |
| | 148 | Lid |
| α | | Angle formed by the top wall with respect to the radial plane of the dispensing chamber |

The invention claimed is:

1. A dispensing head for closing a receptacle, said dispensing head comprising:

a dispensing head body having an outlet orifice, a hinge cap for closing the outlet orifice, wherein the hinge cap is integrally moulded onto the dispensing head, anchoring means fixing the hinge cap on the dispensing head body, wherein said anchoring means comprises first anchoring means carried by the dispensing head body and second anchoring means carried by the hinge cap, one of the first and the second anchoring means being a groove and the other of the first and second anchoring means being a tongue entering the groove, wherein the groove has a radial hole formed in a wall of the groove, and the tongue has a radial protrusion that enters the hole, wherein the hinge cap is moulded onto the dispensing head body so that the tongue is gripped in the groove, wherein a barrier impervious to at least one of odours and gases is integrated in at least one of the dispensing head body and the hinge cap, wherein the barrier is in the form of an insert, and wherein the groove is carried by the hinge cap and the tongue entering the groove is carried by the dispensing head body.

2. A receptacle comprising a receptacle body and the dispensing head according to claim 1, wherein the dispensing head is welded to the receptacle body.

3. The dispensing head according to claim 1, wherein the hinge cap and the dispensing head body are produced from the same material in the same colour or in different colours.

4. The dispensing head according to claim 1, wherein a lid that is at least one of removable and capable of being perforated closes the orifice in the dispensing head body.

5. The dispensing head according to claim 1, wherein sealing means are provided on at least one of the dispensing head body and the hinge cap in order to seal the receptacle when the hinge cap is closed.

6. The dispensing head according to claim 1, wherein means are provided for facilitating the opening of the hinge cap with a finger.

7. The dispensing head according to claim 1, comprising means for moving the hinge cap substantially into a wide-open position and/or substantially into the closed position, when the hinge cap is not subjected to any external force.

8. The dispensing head according to claim 1, which has a radial top wall inclined with a respect to a radial plane by an angle of between 5° and 45°.

9. The dispensing head according to claim 1, wherein at least one of the dispensing head and the hinge cap are produced from EVA, ORGALLOY® thermoplastic alloy, PP, HDPE or LDPE.

10. The dispensing head according to claim 6, wherein the finger is in the form of a bonnet.

11. The dispensing head according to claim 8, wherein the radial top wall is inclined with a respect to the radial plane by an angle of 15°.

12. The dispensing head according to claim 1, wherein the hinge cap and the dispensing head are produced from different materials having the same colour or different colours.

13. The dispensing head according to claim 1, wherein the hinge cap and the dispensing head are produced from materials that are compatible with each other.

14. The dispensing head according to claim 1, wherein the hinge cap and the dispensing head are produced from materials that are incompatible with each other.

15. The dispensing head according to claim 1, wherein the groove has a plurality of radial holes formed in a wall of the groove, and the tongue has a plurality of radial protrusions that enters the holes.

16. The dispensing head according to claim 15, wherein the holes are located in an external wall of the groove.

17. The dispensing head according to claim 16, wherein the protrusions on the tongue are in the shape of cylinders that define hooks.

* * * * *